US011731450B2

(12) United States Patent
Cauwels et al.

(10) Patent No.: US 11,731,450 B2
(45) Date of Patent: Aug. 22, 2023

(54) CONVERTIBLE WRITING ASSEMBLIES AND COMPONENTS THEREOF

(71) Applicant: Sanford L.P., Atlanta, GA (US)

(72) Inventors: Kyle Frank Cauwels, Roswell, GA (US); Melanie Nicole Kregg, Roswell, GA (US)

(73) Assignee: SANFORD, L.P., Atlanta, GA (US)

( * ) Notice: Subject to any disclaimer, the term of this patent is extended or adjusted under 35 U.S.C. 154(b) by 0 days.

(21) Appl. No.: 17/766,115

(22) PCT Filed: Oct. 7, 2020

(86) PCT No.: PCT/US2020/054501

§ 371 (c)(1),
(2) Date: Apr. 1, 2022

(87) PCT Pub. No.: WO2021/071891

PCT Pub. Date: Apr. 15, 2021

(65) Prior Publication Data

US 2022/0339961 A1 Oct. 27, 2022

Related U.S. Application Data

(60) Provisional application No. 62/912,598, filed on Oct. 8, 2019.

(51) Int. Cl.
*B43K 27/00* (2006.01)
*B43K 5/00* (2006.01)
(Continued)

(52) U.S. Cl.
CPC ..... *B43K 27/003* (2013.01); *B43K 5/005* (2013.01); *B43K 5/16* (2013.01); *B43K 7/005* (2013.01);
(Continued)

(58) Field of Classification Search
CPC ..... B43K 27/003; B43K 5/005; B43K 5/16; B43K 7/005; B43K 21/006; B43K 21/02; B43K 27/006; B43K 29/02
(Continued)

(56) References Cited

U.S. PATENT DOCUMENTS 2,951,465 A 9/1960 Weisser et al.
4,976,561 A 12/1990 Kageyama
(Continued)

OTHER PUBLICATIONS

International Search Reported dated Jan. 26, 2021.

*Primary Examiner* — David J Walczak
(74) *Attorney, Agent, or Firm* — Eversheds Sutherland (US) LLP

(57) ABSTRACT

Convertible writing instrument assemblies are provided, including an outer barrel having a tapered nosecone with an aperture for a writing instrument tip and a grip portion, and an aperture for receiving an eraser or a push button therethrough, wherein the writing instrument assembly provides selective access to a volume defined by the outer barrel, and wherein the outer barrel and the volume are collectively configured to operably and interchangeably receive a mechanical pencil insert having the eraser and a retractable pen insert having the push button. Mechanical pencils and pens utilizing the convertible writing instrument assemblies are also provided, along with kits for providing such mechanical pencils and pens.

20 Claims, 3 Drawing Sheets

(51) Int. Cl.

| | |
|---|---|
| ***B43K 5/16*** | (2006.01) |
| ***B43K 7/00*** | (2006.01) |
| ***B43K 21/00*** | (2006.01) |
| ***B43K 29/02*** | (2006.01) |
| ***B43K 21/02*** | (2006.01) |

(52) U.S. Cl.
CPC ..... *B43K 21/006* (2013.01); *B43K 21/02* (2013.01); *B43K 27/006* (2013.01); *B43K 29/02* (2013.01)

(58) Field of Classification Search
USPC ..... 401/195, 6, 92–96, 112–117
See application file for complete search history.

(56) References Cited

U.S. PATENT DOCUMENTS

| | | | | |
|---|---|---|---|---|
| 5,642,953 | A | 7/1997 | Kobayashi et al. | |
| 5,810,496 | A | 9/1998 | Kageyama et al. | |
| 10,635,203 | B2 * | 4/2020 | Rolion ..... | B43K 5/005 |
| 2005/0100387 | A1 | 5/2005 | Odaka | |
| 2013/0170885 | A1 | 7/2013 | Wisler et al. | |

* cited by examiner

CONVERTIBLE WRITING ASSEMBLIES AND COMPONENTS THEREOF

CROSS REFERENCE TO RELATED APPLICATIONS

This application is a 35 U.S.C. § 371 national stage application of PCT Patent Application No. PCT/US2020/054501, filed Oct. 7, 2020, which claims priority benefit of U.S. Provisional Application No. 62/912,598, filed Oct. 8, 2019, the disclosures of which are incorporated by reference herein in their entireties.

BACKGROUND

The present disclosure relates generally to writing instruments, and more particularly relates to convertible writing assembles and components thereof.

Writing instruments, such as mechanical pencils and pens, are generally known. Certain pens have a pen body or housing that is configured to receive pen refills that can be replaced by the user upon depletion of the ink therefrom. For example, in such pens, the body may be configured to be opened or to otherwise provide selective access to the inner chamber, so that a user may remove a depleted ink refill and introduce a new ink refill therein. However, typically such pens can be refilled only with identical ink refill cartridges.

Thus, there is a need for convertible writing instruments that provide additional flexibility and functionality for operably receiving both pen and pencil inserts in a single body design.

SUMMARY

In one aspect, convertible writing instrument assemblies are provided. A convertible writing instrument assembly includes an outer barrel having a tapered nosecone with an aperture for a writing instrument tip and a grip portion, and an aperture for receiving an eraser or a push button therethrough. The writing instrument assembly provides selective access to a volume defined by the outer barrel, and the outer barrel and the volume are collectively configured to operably and interchangeably receive a mechanical pencil insert having the eraser and a retractable pen insert having the push button.

In certain aspects, mechanical pencils are provided. A mechanical pencil includes the convertible writing instrument assembly in combination with a mechanical pencil insert that includes a writing tip (optionally retractable) positioned at a proximal end of the insert, the writing tip being configured to secure a pencil lead for writing therein, a body into which the writing tip may be retractable, a lead tube for containing a plurality of pencil lead, the lead tube positioned at least partially within the body and coupled to the writing tip, an eraser holder secured at a proximal end within the body, and the eraser secured within a distal end of the eraser holder at a distal end of the insert.

In certain aspects, pens are provided. A pen includes the convertible writing instrument assembly in combination with a retractable pen insert that includes an ink tube for containing an ink formulation, a writing tip in communication with the ink tube and configured to discharge the ink formulation therefrom, and a push button for retractably advancing the writing tip.

In another aspect, kits are provided. A kit includes the convertible writing instrument assembly and one or more mechanical pencil inserts and/or retractable pen inserts.

BRIEF DESCRIPTION OF THE DRAWINGS

The detailed description is set forth with reference to the drawings, which are meant to be exemplary and not limiting, illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

The present disclosure will now be described by reference to more detailed embodiments. This disclosure may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this disclosure belongs. The terminology used in the disclosure herein is for describing particular embodiments only and is not intended to be limiting of the invention. As used in the description of the invention and the appended claims, the singular forms "a," "an," and "the" are intended to include the plural forms as well, unless the context clearly indicates otherwise. All publications, patent applications, patents, and other references mentioned herein are expressly incorporated by reference in their entirety.

As discussed herein, embodiments of the present disclosure beneficially provide convertible writing instruments configured to operably receive both pen and pencil inserts in a single body design. Thus, these embodiments provide additional flexibility and functionality over known writing instrument designs.

Figure 2A:
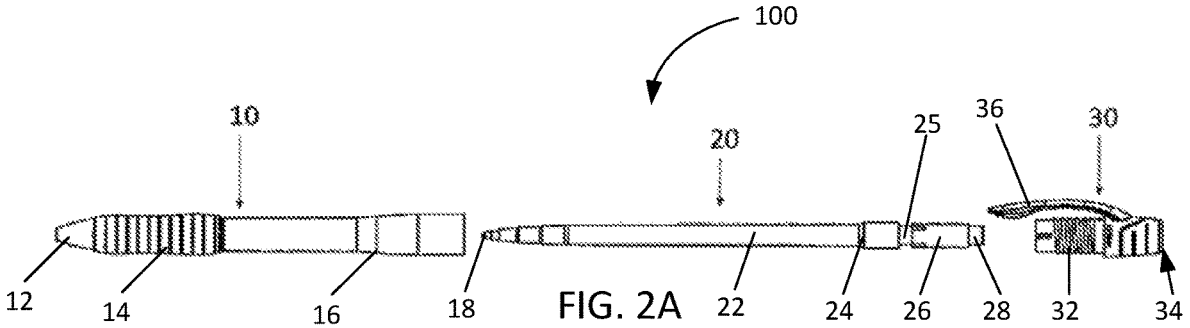
FIG. 2A illustrates an exploded view of a convertible writing instrument assembly incorporating a mechanical pencil insert, in accordance with the present disclosure.

In one aspect, convertible writing instrument assemblies are provided in which an outer barrel of the writing instrument is able to operably receive distinct writing instrument inserts (e.g., a mechanical pencil insert, a retractable pen insert), such that a single writing instrument body may be utilized, without modification, for various writing instrument configurations. In certain embodiments, as shown in FIG. 2A, a convertible writing instrument assembly 100 includes an outer barrel 10 having a tapered nosecone 12 with an aperture for a writing instrument tip and a grip portion 14, and an aperture 34 for receiving an eraser 28 or a push button 42 therethrough. The writing instrument assembly 100 may provide selective access to an internal volume defined by the outer barrel 10, and the outer barrel 10 and the internal volume may be collectively configured to operably and interchangeably receive a mechanical pencil insert having the eraser and a retractable pen insert having the push button. That is, a user or manufacturer may be able to remove the clip assembly, nosecone, or other selectively removable component, and introduce a pencil or pen insert into the outer barrel 10, to provide a functional writing instrument.

Figure 3A:
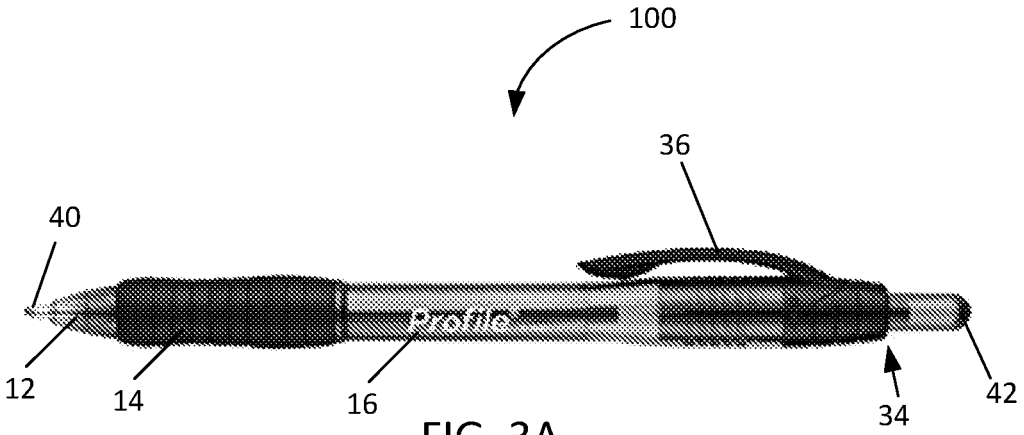
FIG. 3A illustrates one embodiment of a convertible writing instrument assembly incorporating a pen insert, in accordance with the present disclosure.

The writing instrument assembly 100 may provide selective access to an internal volume defined by the outer barrel 10 in any of a variety of suitable ways. For example, the writing instrument may provide selective access to the volume defined by the outer barrel via the nosecone being removably coupled to the remainder of the outer barrel. In such embodiments, the remainder of the outer barrel may have an inner surface having a threaded portion at its proximal end and the nosecone may have a threaded portion for threaded engagement with the threaded portion of the remainder of the outer barrel. In other embodiments, as illustrated throughout the figures, the writing instrument assembly provides the selective access to the volume defined by the outer barrel via a clip assembly configured to be removably coupled to a distal end of the outer barrel opposite the nosecone. In such embodiments, the outer barrel 10 and the clip assembly 30 are collectively configured to operably and interchangeably receive a mechanical pencil insert 20 having an eraser 28 and a pen insert having the push button 42 (as shown in FIG. 3A). For example, the clip assembly may define the aperture for receiving the eraser or push button therethrough. In other embodiments, the clip may be integral with the outer barrel, but a removable end cap defining the aperture for the eraser and push button may be provided.

As used herein, the phrase "grip portion" refers to a region or area of the body of the outer barrel of the writing instrument at which a user grips the writing instrument during a writing action. In some embodiments, the grip portion may be defined by a surface of the outer barrel. In other embodiments, as illustrated in the figures, the grip portion 14 may include a further grippable material (e.g., rubber) coating or overlaid component disposed on the outer barrel and that configured to provide enhance gripping for a user.

Thus, convertible writing instrument assemblies including the outer barrel 10 and any other components (e.g., clip assembly 30) in combination with one of a suitable pen or pencil insert are provided. Kits containing the outer barrel and optional other components (e.g., clip assembly) with one or more mechanical pencil and/or retractable pen inserts are also provided. Mechanical pencils including the outer barrel, along with a mechanical pencil insert are also provided. Retractable pens including the outer barrel, along with a retractable pen insert are also provided.

Figure 2B:
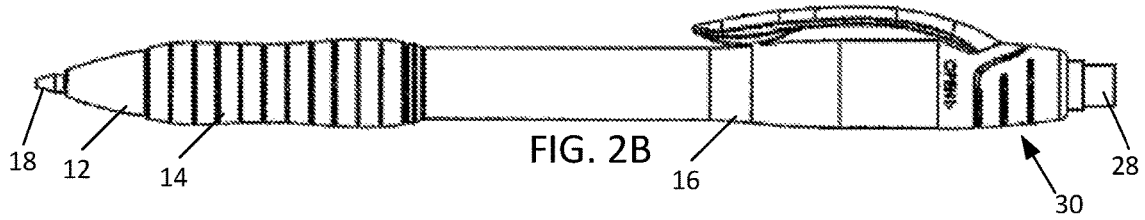
FIG. 2B illustrates an external side view of the writing instrument assembly of FIG. 2A.
Figure 2C:
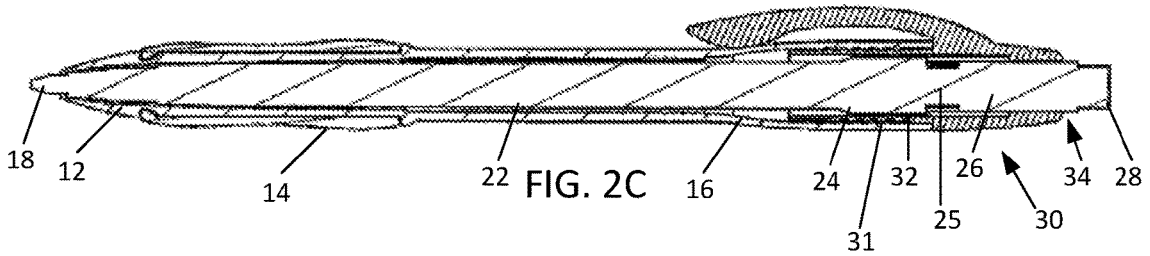
FIG. 2C illustrates a cross-sectional side view of the writing instrument assembly of FIG. 2B.

In certain embodiments, as shown in FIGS. 2A and 2C, the outer barrel 10 has an inner surface having a threaded portion 31 at (e.g., at or near) its distal end and the clip assembly 30 has a threaded portion 32 for threaded engagement with the threaded portion 31 of the outer barrel 10. In alternate embodiments, the clip assembly may be coupled with the outer barrel by other suitable means, such as snap fit, friction fit, or press fit.

In certain embodiments, as shown in FIG. 2C, the outer barrel 10 has an inner surface having a tapered portion 16 configured to engage a corresponding tapered portion or ledge 24 of the mechanical pencil insert 20 and the retractable pen insert, such as when the inserts are in the extended, or functional, position (i.e., not the retracted position), to limit axial motion of the insert within the outer barrel.

Figure 1A:
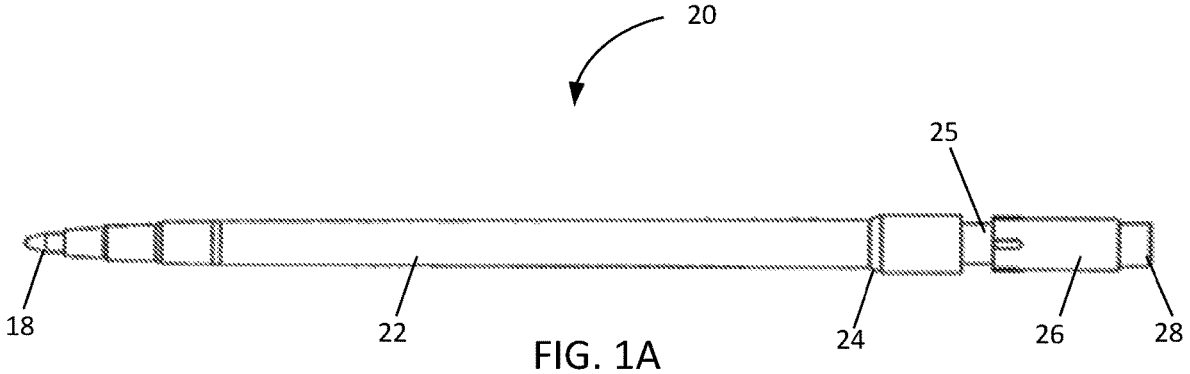
FIG. 1A illustrates one embodiment of a mechanical pencil insert for use in a convertible writing instrument assembly, in accordance with the present disclosure.
Figure 1B:
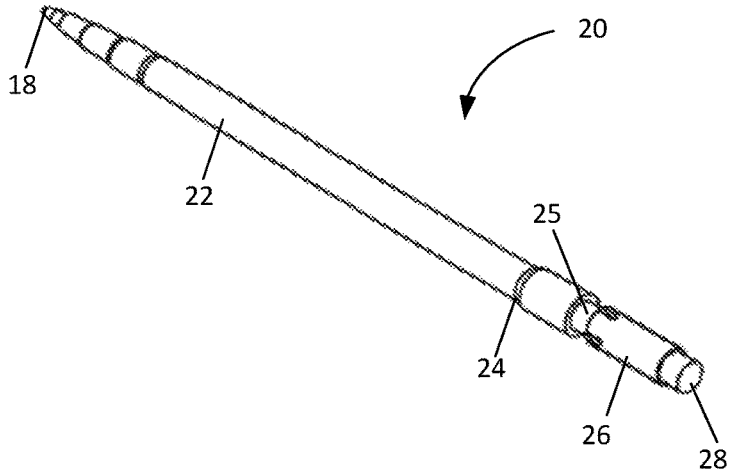
FIG. 1B illustrates another view of the mechanical pencil insert of FIG. 1A.

As shown in FIGS. 2A-2C, in certain aspects the disclosure relates to the writing assembly 100, which is a mechanical pencil. For example, the convertible writing instrument described herein may contain a mechanical pencil insert 20, as illustrated in FIGS. 1A-1B. In some embodiments, a mechanical pencil insert 20 includes: a writing tip 18 (optionally retractable) positioned at a proximal end of the insert 20, the writing tip 18 being configured to secure a pencil lead for writing therein, a body 22 into which the writing tip 18 may be retractable, and a lead tube 25 for containing a plurality of pencil lead, the lead tube 25 being positioned at least partially within the body 22 and coupled (e.g., either directly or indirectly) to the writing tip 18. In certain embodiments, the insert 20 also includes an eraser holder 26 secured at a proximal end of the body 22 and an eraser 28 secured at the distal end of the eraser holder 26 at a distal end of the insert 20. For example, each of the eraser holder and eraser respectively may be secured within the insert 20 by any suitable direct or indirect attachment or coupling means, such as snap fit, friction fit, or press fit.

In certain embodiments, as shown in FIG. 1A-1B, the eraser holder 26 has an aperture therein (not visible) in communication with the lead tube 25, to provide a pathway for introducing pencil lead to the lead tube 25 upon removal of the eraser 28 from the eraser holder 26. That is, in use, one may remove the eraser 28 from the eraser holder 26, to access the aperture through which pencil lead may be introduced into the lead tube 25. A plurality of lead may be contained within the lead tube, for advancement through writing tip 18 in use. For example, in embodiments in which the pencil is retractable, the mechanical pencil insert 20 may be operable to advance a single pencil lead through the writing tip 18 by a user pressing the eraser 28 or eraser holder 26 toward the body 22, to actuate the lead tube 25 within the body 22 and retractably advance the pencil lead from the writing tip 18.

In some embodiments, the mechanical pencil insert 20 further is operable to advance the writing tip 18 from the body by a user pressing the eraser 28 or eraser holder 26 toward the body 22, to actuate the lead tube within the body and retractably advance the writing tip 18 from the body. That is, as shown in FIGS. 2A-2C, the writing tip 18, in a retracted position (not shown), is positioned within the body 22 of the mechanical pencil insert 20, which is positioned within the nosecone 12 of the outer barrel 10 of the writing instrument assembly 100. For example, as shown in FIG. 2A, the body 22 of the mechanical pencil insert 20 may have a proximal end that is tapered or otherwise configured to fit at least partially within the nosecone 12 of the outer barrel 10. The writing tip 18 (e.g., a metal writing tip) may be retracted within the body 22 (e.g., a plastic body portion, such as the tapered portion shown in FIG. 2A), such that the writing tip may be retracted within the writing instrument assembly to avoid damage to clothing, bags, or other items containing or interacting with the writing instrument assembly.

In some embodiments, the mechanical pencil insert 20 is configured such that the writing tip 18 and the pencil lead are independently advanceable and retractable. For example, in use, the retracted writing tip 18 may be advanced by a user by applying and removing a force to the eraser/eraser holder and then the pencil lead may be separately advanced through a similar action. To retract the lead, a force pressing the eraser/eraser holder may be maintained while an opposite force (e.g., against a surface) is applied to the lead. Similarly, the writing tip 18 may be retracted by applying a force to the eraser/eraser holder while applying an opposite force to the writing tip 18. In other embodiments, the writing tip 18 is not retractable.

Thus, in embodiments in which the convertible writing assembly is configured as a mechanical pencil, the mechanical pencil insert 20 may be sized and shaped to operably fit within the outer barrel 10. For example, the mechanical pencil insert 20 may be an independently functional mechanical pencil, but may be combined with a user-friendly outer housing (e.g., outer barrel 10 with grip 14) that provides an improved writing experience for the user as well as an optional functional clip assembly 30. For example, the eraser 28 may extend through the aperture 34 in the clip assembly or through an aperture otherwise defined at the distal end of the writing instrument assembly (e.g., a removable or integral end cap or other structure).

Figure 3B:
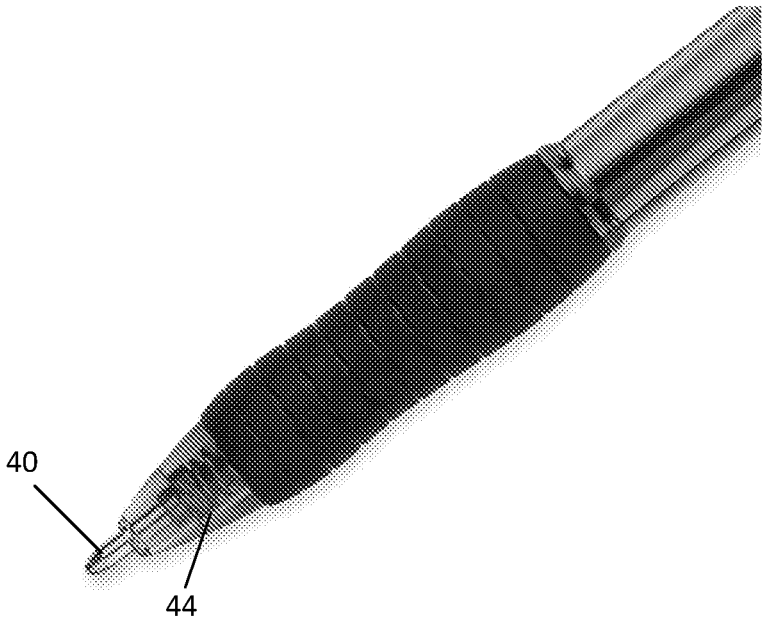
FIG. 3B illustrates a partial magnified view of the convertible writing instrument assembly of FIG. 3A.

As shown in FIGS. 3A-3B, in certain aspects the disclosure relates to the writing assembly 100, which is a retractable pen. For example, the convertible writing instrument described herein may contain a retractable pen insert. For example, a suitable retractable pen insert may include an ink tube for containing an ink formulation, a writing tip 40 in communication with the ink tube and configured to discharge the ink formulation therefrom, and a push button 42 for retractably advancing the writing tip.

In certain embodiments, the push button 42 extends through the aperture of the clip assembly 30. In other embodiments, as described herein, the aperture may be defined by another structure (e.g., end cap structure) at the distal end of the writing instrument assembly.

In certain embodiments, the writing assembly 100 further includes a compression spring 44 positioned at the nosecone 12 and configured to receive a proximal end of the ink tube therethrough, to bias the writing tip 40 in a retracted position (not shown). In some embodiments, the retractable pen insert is operable to advance the writing tip 40 from the outer barrel 10 of the writing instrument assembly 100 by a user pressing the push button 42 toward the outer barrel, to actuate the ink tube within the outer barrel 10 and retractably advance the writing tip 40 from the outer barrel 10 (e.g., from the nosecone 12). Thus, in a retracted position, the writing tip 40 may be positioned within the nosecone 12 of the outer barrel 10 of the writing instrument assembly 100.

Overall, the writing instrument assemblies of the present disclosure may provide a labor, materials, and cost-efficient process for converting a retractable pen into a mechanical pencil or vice versa. For example, known writing instruments having pen and pencil alternatives traditionally use unique parts for equivalent components on the pen and pencils. That is, such pens and pencils are not interchangeable but instead require unique components for functionality, which eliminates the ability to utilize a similar housing or assembly with multiple writing inserts (e.g., with alternative pen and pencil inserts). For example, even though the pen and mechanical pencil may appear to have similar features to a user, typically components such as the nosecone, barrel, clip, or clip assembly are not interchangeable due to modifications that are necessary to make the component(s) work with the respective pen or pencil.

Beneficially, the present disclosure relates to writing instrument assemblies in which the outer barrel or housing of the writing instrument (e.g., the main body that is held by a user during a writing action), the nosecone, the clip, and the optional clip assembly are identical between embodiments that are configured as a mechanical pencil and embodiments that are configured as a retractable pen. In these designs, these assemblies are fully convertible between operable mechanical pencil and pen embodiments.

Further, the present writing assemblies advantageously provide for the accommodation of an eraser associated with the mechanical pencil insert, to provide full functionality to a user for erasing errant marks. Additionally, these writing instrument assemblies provide the ability to retract not only the pencil lead but also the writing tip of the pencil mechanism within the body of the writing instrument so that it is not exposed at all times, which may beneficially prevent injury and damage to clothing or other property. In other known pencil designs, the writing tip is permanently protruding from the body, which can be dangerous and messy. In the present disclosure, the writing instruments in both the retractable pen and mechanical pencil embodiments provide for full retraction of the writing tip within the nosecone of the outer barrel.

While the disclosure has been described with reference to a number of embodiments, it will be understood by those skilled in the art that the invention is not limited to such disclosed embodiments. Rather, the invention can be modified to incorporate any number of variations, alterations, substitutions, or equivalent arrangements not described herein, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A convertible writing instrument assembly, comprising:

an outer barrel comprising a tapered nosecone having an aperture for a writing instrument tip and a grip portion; and an aperture for receiving an eraser or a push button therethrough, wherein the writing instrument assembly provides selective access to a volume defined by the outer barrel via a clip assembly configured to be removably coupled to a distal end of the outer barrel opposite the nosecone, wherein the outer barrel and the volume are collectively configured to operably and interchangeably receive a mechanical pencil insert having the eraser and a retractable pen insert having the push button, wherein the outer barrel comprises an inner surface having a threaded portion at its distal end, and wherein the clip assembly comprises a threaded portion for threaded engagement with the threaded portion of the outer barrel.

2. The convertible writing instrument of claim 1, wherein the clip assembly comprises the aperture for receiving the eraser or push button therethrough.

3. The convertible writing instrument of claim 1, wherein the outer barrel comprises an inner surface having a tapered portion configured to engage a corresponding tapered portion or ledge of the mechanical pencil insert and the retractable pen insert.

4. A mechanical pencil, comprising:

a convertible writing instrument assembly comprising:

an outer barrel comprising a tapered nosecone having an aperture and a grip portion; and an aperture for receiving an eraser or a push button therethrough; and a mechanical pencil insert comprising:

a retractable writing tip positioned at a proximal end of the insert, the retractable writing tip being configured to secure a pencil lead for writing therein, such that the pencil lead is extendable through the aperture of the tapered nosecone;

a body configured such that the retractable writing tip is retractable therein;

a lead tube for containing a plurality of pencil lead, the lead tube positioned at least partially within the body and coupled to the retractable writing tip; and an eraser holder secured at a proximal end within the body, wherein an eraser is secured within a distal end of the eraser holder at a distal end of the insert, wherein the writing instrument assembly provides selective access to a volume defined by the outer barrel, and wherein the outer barrel and the volume are collectively configured to operably and interchangeably receive the mechanical pencil insert and a retractable pen insert having the push button.

5. The mechanical pencil of claim 4, wherein the eraser holder is secured within the body by a press fit or a snap fit.

6. The mechanical pencil of claim 4, wherein the eraser is secured within the eraser holder by a press fit or snap fit.

7. The mechanical pencil of claim 4, wherein the eraser holder has an aperture therein in communication with the lead tube, to provide a pathway for introducing the pencil lead to the lead tube upon removal of the eraser from the eraser holder.

8. The mechanical pencil of claim 4, wherein the mechanical pencil insert is operable to advance a single pencil lead through the retractable writing tip by a user pressing the eraser or eraser holder toward the body, to actuate the lead tube within the body and retractably advance the pencil lead from the retractable writing tip.

9. The mechanical pencil of claim 4, wherein the mechanical pencil insert is operable to advance the retractable writing tip from the body by a user pressing the eraser or eraser holder toward the body, to actuate the lead tube within the body and retractably advance the retractable writing tip from the body.

10. The convertible writing instrument of claim 4, wherein the writing instrument assembly provides the selective access to the volume defined by the outer barrel via the nosecone being removably coupled to a remainder of the outer barrel.

11. The convertible writing instrument of claim 10, wherein:

the remainder of the outer barrel comprises an inner surface having a threaded portion at its proximal end; and the nosecone comprises a threaded portion for threaded engagement with the threaded portion of the remainder of the outer barrel.

12. The convertible writing instrument of claim 4, wherein the writing instrument assembly provides the selective access to the volume defined by the outer barrel via a clip assembly configured to be removably coupled to a distal end of the outer barrel opposite the nosecone.

13. The convertible writing instrument of claim 12, wherein the clip assembly comprises the aperture for receiving the eraser or push button therethrough.

14. The mechanical pencil of claim 12, wherein the eraser extends through an aperture of a clip assembly.

15. The convertible writing instrument of claim 4, wherein the outer barrel comprises an inner surface having a tapered portion configured to engage a corresponding tapered portion or ledge of the mechanical pencil insert and the retractable pen insert.

16. A pen, comprising:

a convertible writing instrument assembly comprising:

an outer barrel comprising a tapered nosecone having an aperture and a grip portion; and an aperture for receiving an eraser or a push button therethrough; and a retractable pen insert comprising:

an ink tube for containing an ink formulation;

a writing tip in communication with the ink tube and configured to discharge the ink formulation therefrom;

a push button for retractably advancing the writing tip through the aperture of the tapered nosecone; and a compression spring positioned at the nosecone and configured to receive a proximal end of the ink tube therethrough, to bias the writing tip in a retracted position, wherein the writing instrument assembly provides selective access to a volume defined by the outer barrel, and wherein the outer barrel and the volume are collectively configured to operably and interchangeably receive a mechanical pencil insert having the eraser and the retractable pen insert having the push button.

17. The pen of claim 16, wherein the writing tip, in a retracted position, is positioned within the nosecone of the outer barrel of the writing instrument assembly.

18. The pen of claim 16, wherein the writing instrument assembly provides the selective access to the volume defined by the outer barrel via the nosecone being removably coupled to a remainder of the outer barrel.

19. The pen of claim 18, wherein:

the remainder of the outer barrel comprises an inner surface having a threaded portion at its proximal end; and the nosecone comprises a threaded portion for threaded engagement with the threaded portion of the remainder of the outer barrel.

20. The pen of claim 16, wherein the writing instrument assembly provides the selective access to the volume defined by the outer barrel via a clip assembly configured to be removably coupled to a distal end of the outer barrel opposite the nosecone.

* * * * *